US006015151A

United States Patent [19]

Carovillano et al.

[11] Patent Number: 6,015,151

[45] Date of Patent: Jan. 18, 2000

[54] BOCCE BALL TYPE GAME DEVICE

[76] Inventors: G. Walter Carovillano; Carrie A. Carovillano, both of 182 Willson Rd, Welland, Ontario, Canada, L3C 2T6

[21] Appl. No.: 09/086,443

[22] Filed: May 28, 1998

[51] Int. Cl.[7] ..... A63B 67/06; A63D 1/00

[52] U.S. Cl. ..... 273/317; 273/126 R

[58] Field of Search ..... 273/317, 126 R, 273/400, 401, 402

[56] References Cited

U.S. PATENT DOCUMENTS

| | | | |
|---|---|---|---|
| 915,450 | 3/1909 | Levey . | |
| 1,682,279 | 8/1928 | Hilpert | 273/126 R |
| 2,954,978 | 10/1960 | Towle, Jr. | 273/126 R |
| 3,119,619 | 1/1964 | Frank | 273/336 |
| 3,147,977 | 9/1964 | Glassman | 273/126 R |
| 4,203,592 | 5/1980 | Quatkemeyer | 273/336 |
| 5,110,139 | 5/1992 | Baumgartner | 273/400 |
| 5,125,669 | 6/1992 | Kanda | 273/411 |

*Primary Examiner*—William H. Grieb

[57] ABSTRACT

A new bocce ball type game device for playing a disc throwing game with rules similar to bocce ball. The inventive device includes a plurality of discs including a number of tossing discs and a marker disc. Each disc has a center, generally circular first and second faces, and a perimeter side edge between the first and second faces of the disc. Each disc has a generally cylindrical bore extending between its first and second faces. The device also includes a disc carrier comprising a generally U-shaped elongate handle rod having a pair of elongate arms and an elongate crossbar. The disc carrier also has an elongate carrying rod with one of the ends of the carrying rod coupled to the terminal end of one of the arms of the handle rod. The carrying rod is extended from the one of the arms of the handle rod towards the other arm of the handle rod. The terminal end of the other arm of the handle rod has a hook formed thereat into which a portion of the carrying rod is insertable into such that the carrying rod is attached to the another of the arms of the handle rod.

11 Claims, 2 Drawing Sheets

BOCCE BALL TYPE GAME DEVICE

BACKGROUND OF THE INVENTION

1. Field of the Invention

The present invention relates to devices for playing bocce ball games and more particularly pertains to a new bocce ball type game device for playing a disc throwing game with rules similar to bocce ball.

2. Description of the Prior Art

The use of devices for playing bocce ball games is known in the prior art. More specifically, devices for playing bocce ball games heretofore devised and utilized are known to consist basically of familiar, expected and obvious structural configurations, notwithstanding the myriad of designs encompassed by the crowded prior art which have been developed for the fulfillment of countless objectives and requirements.

Known prior art devices for playing bocce ball games include U.S. Pat. No. 4,203,592; U.S. Pat. No. 5,125,669; U.S. Pat. No. 5,110,139; U.S. Pat. No. 3,119,619; U.S. Pat. No. 915,450; PCT Patent No. WO 95/30457 (Inventors: Bouchard et al.); and EPO Patent No. EP 0 310 054 A2 (Inventors: Norman et al.).

While these devices fulfill their respective, particular objectives and requirements, the aforementioned patents do not disclose a new bocce ball type game device. The inventive device includes a plurality of discs including a number of tossing discs and a marker disc. Each disc has a center, generally circular first and second faces, and a perimeter side edge between the first and second faces of the disc. Each disc has a generally cylindrical bore extending between its first and second faces. The device also includes a disc carrier comprising a generally U-shaped elongate handle rod having a pair of elongate arms and an elongate crossbar. The disc carrier also has an elongate carrying rod with one of the ends of the carrying rod coupled to the terminal end of one of the arms of the handle rod. The carrying rod is extended from the one of the arms of the handle rod towards the other arm of the handle rod. The terminal end of the other arm of the handle rod has a hook formed thereat into which a portion of the carrying rod is insertable into such that the carrying rod is attached to the another of the arms of the handle rod.

In these respects, the bocce ball type game device according to the present invention substantially departs from the conventional concepts and designs of the prior art, and in so doing provides an apparatus primarily developed for the purpose of playing a disc throwing game with rules similar to bocce ball.

SUMMARY OF THE INVENTION

In view of the foregoing disadvantages inherent in the known types of devices for playing bocce ball games now present in the prior art, the present invention provides a new bocce ball type game device construction wherein the same can be utilized for playing a disc throwing game with rules similar to bocce ball.

The general purpose of the present invention, which will be described subsequently in greater detail, is to provide a new bocce ball type game device apparatus and method which has many of the advantages of the devices for playing bocce ball games mentioned heretofore and many novel features that result in a new bocce ball type game device which is not anticipated, rendered obvious, suggested, or even implied by any of the prior art devices for playing bocce ball games, either alone or in any combination thereof.

To attain this, the present invention generally comprises a plurality of discs including a number of tossing discs and a marker disc. Each disc has a center, generally circular first and second faces, and a perimeter side edge between the first and second faces of the disc. Each disc has a generally cylindrical bore extending between its first and second faces. The device also includes a disc carrier comprising a generally U-shaped elongate handle rod having a pair of elongate arms and an elongate crossbar. The disc carrier also has an elongate carrying rod with one of the ends of the carrying rod coupled to the terminal end of one of the arms of the handle rod. The carrying rod is extended from the one of the arms of the handle rod towards the other arm of the handle rod. The terminal end of the other arm of the handle rod has a hook formed thereat into which a portion of the carrying rod is insertable into such that the carrying rod is attached to the another of the arms of the handle rod.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new bocce ball type game device apparatus and method which has many of the advantages of the devices for playing bocce ball games mentioned heretofore and many novel features that result in a new bocce ball type game device which is not anticipated, rendered obvious, suggested, or even implied by any of the prior art devices for playing bocce ball games, either alone or in any combination thereof.

It is another object of the present invention to provide a new bocce ball type game device which may be easily and efficiently manufactured and marketed.

It is a further object of the present invention to provide a new bocce ball type game device which is of a durable and reliable construction.

An even further object of the present invention is to provide a new bocce ball type game device which is susceptible of a low cost of manufacture with regard to both materials and labor, and which accordingly is then susceptible of low prices of sale to the consuming public, thereby making such bocce ball type game device economically available to the buying public.

Still yet another object of tile present invention is to provide a new bocce ball type game device which provides in the apparatuses and methods of the prior art some of the advantages thereof, while simultaneously overcoming some of the disadvantages normally associated therewith.

Still another object of the present invention is to provide a new bocce ball type game device for playing a disc throwing game with rules similar to bocce ball.

Yet another object of the present invention is to provide a new bocce ball type game device which includes a plurality of discs including a number of tossing discs and a marker disc. Each disc has a center, generally circular first and second faces, and a perimeter side edge between the first and second faces of the disc. Each disc has a generally cylindrical bore extending between its first and second faces. The device also includes a disc carrier comprising a generally U-shaped elongate handle rod having a pair of elongate arms and an elongate crossbar. The disc carrier also has an elongate carrying rod with one of the ends of the carrying rod coupled to the terminal end of one of the arms of the handle rod. The carrying rod is extended from the one of the arms of the handle rod towards the other arm of the handle rod. The terminal end of the other arm of the handle rod has a hook formed thereat into which a portion of the carrying rod is insertable into such that the carrying rod is attached to the another of the arms of the handle rod.

Still yet another object of the present invention is to provide a new bocce ball type game device that is best played on sand but may be played on any type of ground surface.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
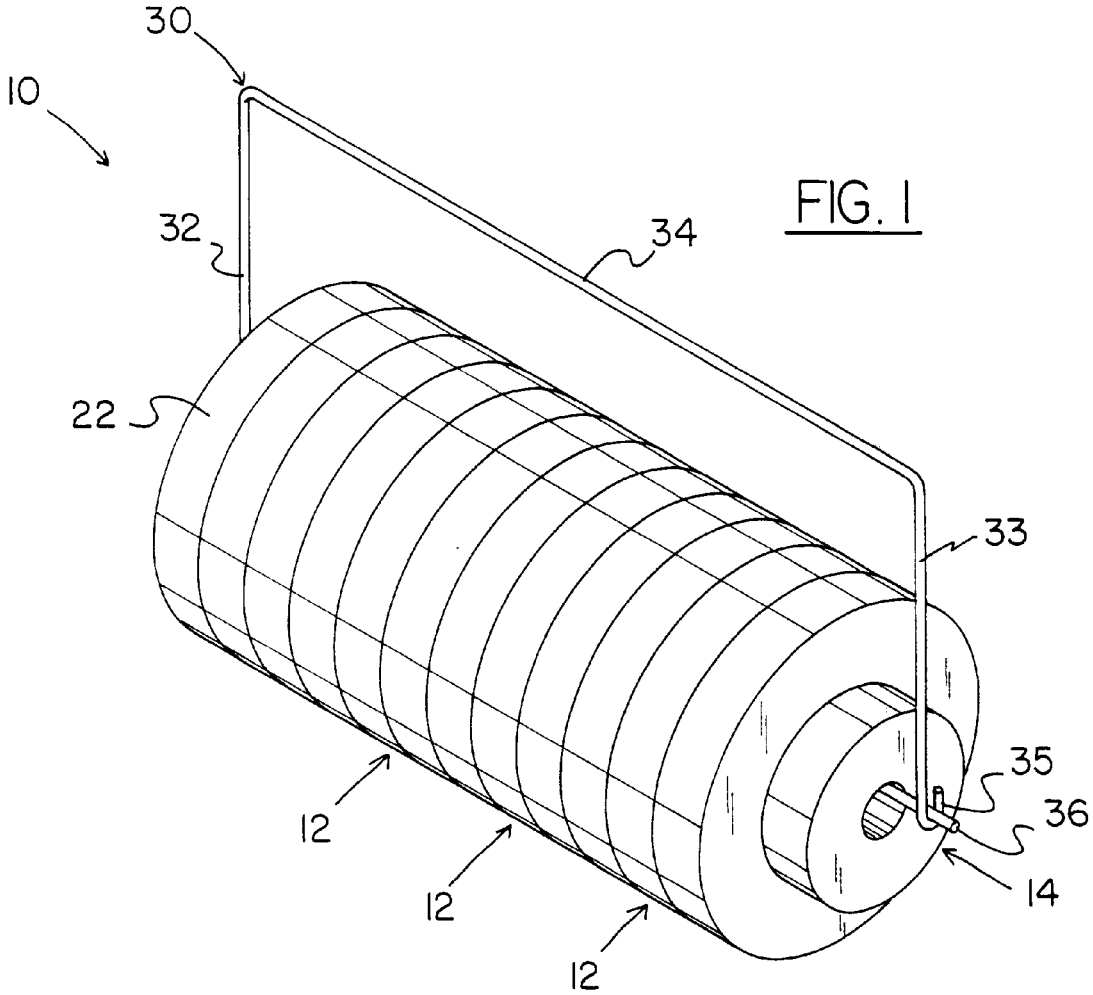
FIG. 1 is a schematic perspective view of a new bocce ball type game device according to the present invention.

With reference now to the drawings, and in particular to FIGS. 1 through 4 thereof, a new bocce ball type game device embodying the principles and concepts of the present invention and generally designated by the reference numeral 10 will be described.

As best illustrated in FIGS. 1 through 4, the bocce ball type game device 10 generally comprises a plurality of discs including a number of tossing discs 12 and a marker disc 14. Each disc has a center, generally circular first and second faces 20,21, and a perimeter side edge 22 between the first and second faces 20,21 of the disc. Each disc has a generally cylindrical bore 23 extending between its first and second faces 20,21. The device also includes a disc carrier 30 comprising a generally U-shaped elongate handle rod 31 having a pair of elongate arms 32,33 and an elongate crossbar 34. The disc carrier 30 also has an elongate carrying rod 36 with one of the ends of the carrying rod 36 coupled to the terminal end of one of the arms 32 of the handle rod 31. The carrying rod 36 is extended from the one of the arms 32 of the handle rod 31 towards the other arm 33 of the handle rod 31. The terminal end of the other arm 33 of the handle rod 31 has a hook 35 formed thereat into which a portion of the carrying rod 36 is insertable into such that the carrying rod 36 is attached to the another of the arms 33 of the handle rod 31.

In closer detail, the device 10 includes a plurality of discs including a number of tossing discs 12 and a marker disc 14. Ideally, the number of tossing discs 12 comprises twelve tossing discs 12 and are preferably divided into a pair of sets each having a common marking or color on each of the discs of the set. Each disc has a center, generally circular first and second faces 20,21, and a perimeter side edge 22 between the first and second faces 20,21 of the disc. Each disc has a generally cylindrical bore 23 which is extended between the first and second faces 20,21. The bore 23 is located at the center of the disc. Preferably, the diameters of the tossing discs 12 arc substantially equal to one another and ideally, the diameter of each of the tossing discs 12 is less than about 4¼ inches. Ideally, the diameter of the marker disc 14 is less than about 2⅜ inches. Each disc has a thickness defined between the first and second faces 20,21 of the disc. Preferably, the thickness' of the tossing discs 12 is substantially equal to one another. Even more preferably, the thickness of the tossing disc 14 is substantially equal to the thickness' of the tossing discs 12. Ideally, the thickness of each disc is less than about ½ inch.

Figure 2:
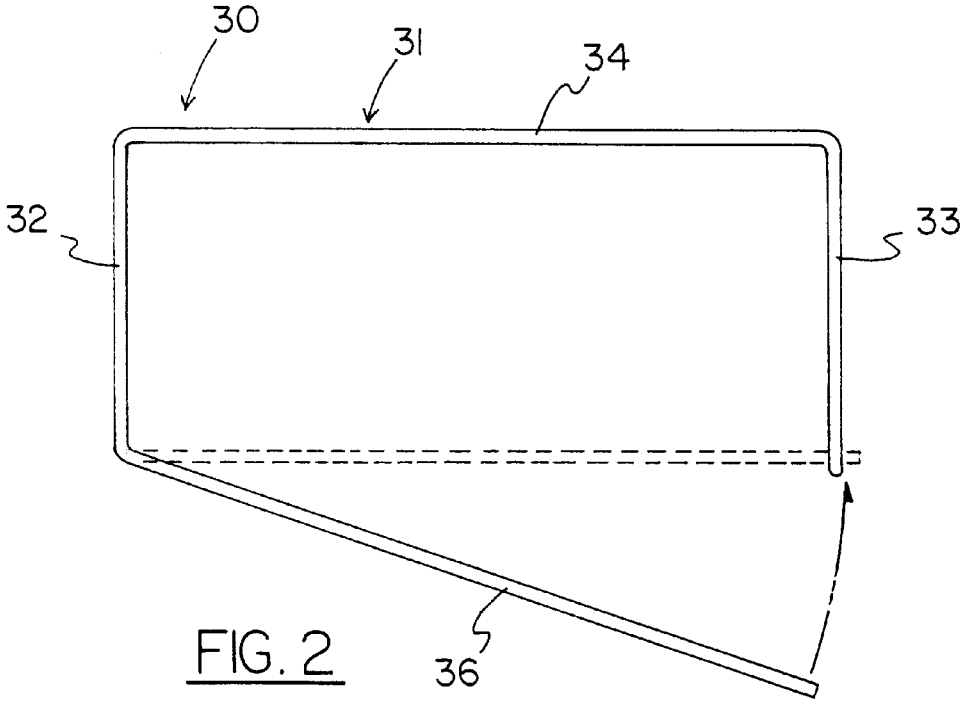
FIG. 2 is a schematic side view of the disc carrier of the present invention.
Figure 3:
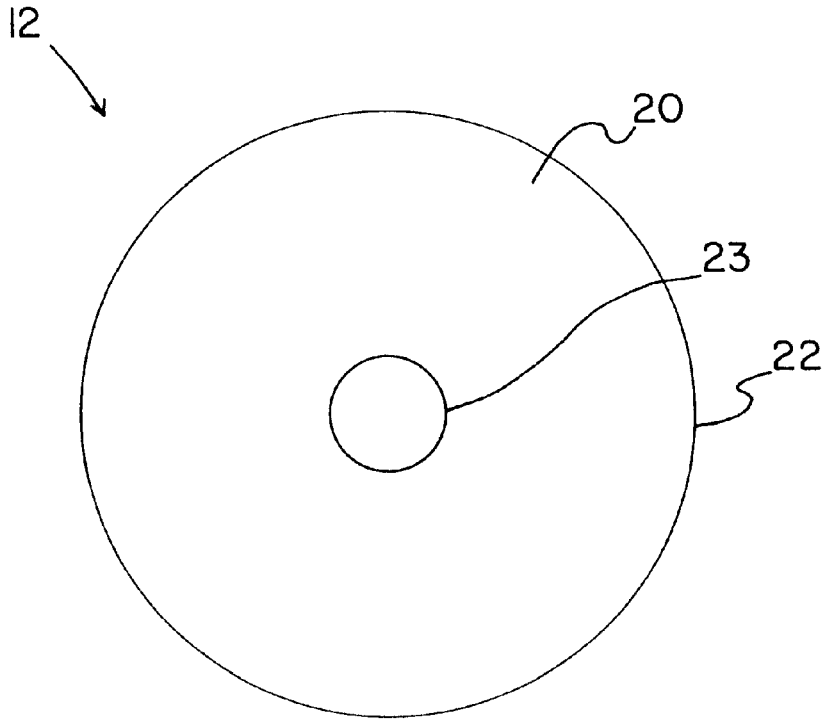
FIG. 3 is a schematic side view of a disc of the present invention.
Figure 4:
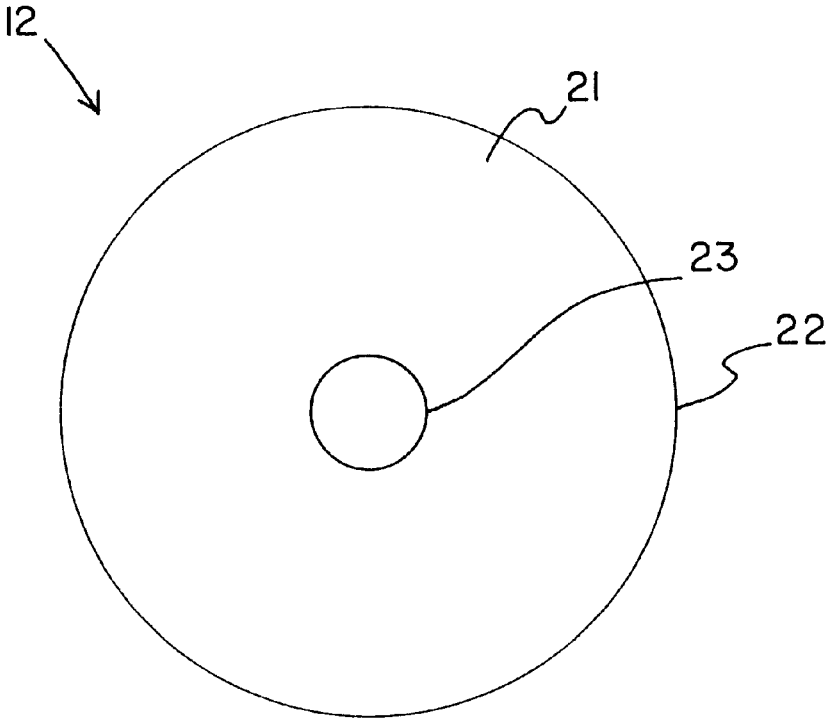
FIG. 4 is a schematic another side view of a disc of the present invention.

With reference to FIGS. 1 and 2 the device 10 includes a disc carrier 30. The disc carrier 30 has a generally inverted U-shaped elongate handle rod 31 with a pair of elongate arms 32,33 and an elongate crossbar 34. Each of the elongate arms 32,33 of the handle rod 31 has a terminal end distal the crossbar 34. The lengths of the arms 32,33 of the handle rod 31 are preferably generally parallel with one another and preferably generally perpendicular with the length of the crossbar 34 of the handle rod 31. Ideally, each of the arms 32,33 of the handle rod 31 has a length of less than about 3½ inches. Ideally, the crossbar 34 of the handle rod 31 has a length defined between the arms 32,33 of the handle rod 31 of less than about 8 inches.

The disc carrier also includes an elongate carrying rod 36 with a pair of opposite ends. Ideally the carrying rod has a length of less than about 9 inches. One of the ends of the carrying rod 36 is coupled to the terminal end of one of the arms 32 of the handle rod 31. Tile carrying rod 36 is extended from the one arm 32 of the handle rod 31 towards the other arm 33 of the handle rod 31 so that, preferably, the length of the carrying rod 36 extends generally parallel with the length of the crossbar 34 of the handle rod 31. The terminal end of the other arm 33 of the handle rod 31 has a hook 35 formed thereat. A portion of the carrying rod 36 is insertable into the hook 35 such that the carrying rod 36 is attached to this arm 33 of the handle rod 31. The other end of the carrying rod 36 is insertable through the bores 23 of the discs such that the carrying rod 36 is extended through the bore 23s of the discs as illustrated in FIG. 1.

In use, the discs are used to play a game of bocce ball using the same rules. Tile players are divided into a pair of teams and each team is given a set of throwing discs. One player throws out the marker disc a distance from a throwing line. The other players then throw their tossing discs towards the marker disc in an attempt to get their discs closest to the marker disc. When the game is not being played, the tossing discs and the marker disc may be stored on the carrying arm of the disc carrier.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A bocce ball-type game apparatus, comprising:

a plurality of discs including a number of tossing discs and a marker disc;

each disc having a center, generally circular first and second faces, and a perimeter side edge between said first and second faces of said disc;

each disc having a generally cylindrical bore being extended between said first and second faces;

each disc having a diameter;

each disc having a thickness defined between said first and second faces of said disc;

a disc carrier comprising:

a generally U-shaped elongate handle rod having a pair of elongate arms and an elongate crossbar, each of said elongate arms of said handle rod having a terminal end;

an elongate carrying rod having a pair of opposite ends, one of said ends of said carrying rod being coupled to said terminal end of one of said arms of said handle rod, said carrying rod being extended from said one of said arms of said handle rod towards another of said arms of said handle rod;

said terminal end of said another of said arms of said handle rod having a hook formed thereat, a portion of said carrying rod being insertable into said hook such that said carrying rod is attached to said another of said arms of said handle rod; and another of said ends of said carrying rod being insertable through said bores of said discs such that said carrying rod is extended through said bores of said discs.

2. The apparatus of claim 1, wherein said number of tossing discs comprises twelve tossing discs.

3. The apparatus of claim 1, wherein said bore of each of said discs is located at said center of said disc.

4. The apparatus of claim 1, wherein said diameters of said tossing discs are substantially equal to one another.

5. The apparatus of claim 1, wherein said diameter of each of said tossing discs is less than about 4¼ inches, and wherein said diameter of said marker disc is less than about 2⅜ inches.

6. The apparatus of claim 1, wherein said thickness' of said tossing discs being substantially equal to one another.

7. The apparatus of claim 1, wherein said thickness of each said tossing disc is less than about ½ inch.

8. The apparatus of claim 1, wherein said thickness of said marker disc is substantially equal to said thickness' of said tossing discs.

9. The apparatus of claim 1, wherein said arms of said handle rod are generally parallel with one another, and said arms of said handle rod are generally perpendicular with said crossbar of said handle rod.

10. The apparatus of claim 1, wherein each of said arms of said handle rod has a length, wherein said lengths of said arms of said handle rod are less than about 3½ inches, and wherein said crossbar of said handle rod having a length defined between said arms of said handle rod, said length of said crossbar of said handle rod being less than about 8 inches.

11. A bocce ball-type game apparatus, comprising:

a plurality of discs including a number of tossing discs and a marker disc, wherein said number of tossing discs comprises twelve tossing discs;

each disc having a center, generally circular first and second faces, and a perimeter side edge between said first and second faces of said disc;

each disc having a generally cylindrical bore being extended between said first and second faces, said bore being located at said center of said disc;

each disc having a diameter;

wherein said diameters of said tossing discs are substantially equal to one another, wherein said diameter of each of said tossing discs is less than about 4¼ inches;

wherein said diameter of said marker disc is less than about 2⅜ inches;

each disc having a thickness defined between said first and second faces of said disc;

wherein said thickness' of said tossing discs being substantially equal to one another, wherein said thickness of each said tossing disc is less than about ½ inch;

wherein said thickness of said marker disc is substantially equal to said thickness' of said tossing discs, wherein said thickness of said marker disc is less than about ½ inch;

a disc carrier comprising:

a generally U-shaped elongate handle rod having a pair of elongate arms and an elongate crossbar, each of said elongate arms of said handle rod having a terminal end;

said arms of said handle rod being generally parallel with one another, said arms of said handle rod being generally perpendicular with said crossbar of said handle rod;

wherein each of said arms of said handle rod has a length, wherein said lengths of said arms of said handle rod are less than about 3½ inches;

wherein said crossbar of said handle rod having a length defined between said arms of said handle rod, said length of said crossbar of said handle rod being less than about 8 inches;

an elongate carrying rod having a pair of opposite ends, one of said ends of said carrying rod being coupled to said terminal end of one of said arms of said handle rod, said carrying rod being extended from said one of said arms of said handle rod towards another of said arms of said handle rod said carrying rod being extended generally parallel with said crossbar of said handle rod;

said terminal end of said another of said arms of said handle rod having a hook formed thereat, a portion of said carrying rod being insertable into said hook such that said carrying rod is attached to said another of said arms of said handle rod; and another of said ends of said carrying rod being insertable through said bores of said discs such that said carrying rod is extended through said bores of said discs.

* * * * *